US005746192A

United States Patent [19]

Gissel

[11] Patent Number: 5,746,192

[45] Date of Patent: May 5, 1998

[54] AUTOMATIC BOW RETENTION DEVICE

[76] Inventor: Edward B. Gissel, 4243 Midway Ave., Grants Pass, Oreg. 97527

[21] Appl. No.: 771,525

[22] Filed: Dec. 23, 1996

[51] Int. Cl.[6] ..... F41B 5/14

[52] U.S. Cl. ..... 124/1; 124/86; 254/223

[58] Field of Search ..... 124/1, 23.1, 25.6, 124/86, 88; 254/217, 218, 223, 237, 244

[56] References Cited

U.S. PATENT DOCUMENTS

| | | | |
|---|---|---|---|
| 662,133 | 11/1900 | Passmore | 254/223 X |
| 845,102 | 2/1907 | Lewis | 254/217 |
| 1,353,083 | 9/1920 | Stephens | 254/223 |
| 1,401,739 | 12/1921 | Ryals | 254/217 |
| 4,074,409 | 2/1978 | Smith | 124/23.1 X |
| 4,195,397 | 4/1980 | Saunders | 124/23.1 X |
| 4,291,452 | 9/1981 | Whitman et al. | 124/23.1 X |
| 4,886,039 | 12/1989 | Wagner | 124/25.6 |
| 5,125,389 | 6/1992 | Paff | 124/86 |
| 5,425,350 | 6/1995 | Egusquiza | 124/86 |

*Primary Examiner*—John A. Ricci

[57] ABSTRACT

An automatic bow retention device for the purpose of holding a compound archery bow under tension while removing tension from the bowstring. The device is comprised of a flexible cord which attaches to the archery bow at its two ends, a cord spool upon which the flexible cord is wound, a housing in which the spool is free to rotate and through which the cord passes, and a ratchet mechanism which engages the cord spool to the housing. A flexible spring is connected between the cord spool and the housing for automatically retracting the flexible cord onto the spool as the bow is flexed by drawing the bowstring. The ratchet mechanism comprises a pawl attached to the cord spool and ratchet teeth attached to the housing such that the pawl engages the ratchet teeth to prevent the spool from unwinding the flexible cord, thereby holding the bow under tension. Other arrangements of the pawl and ratchet teeth are possible. The ratchet mechanism includes a switch to select engagement or release of the ratchet mechanism as the bowstring is drawn.

7 Claims, 6 Drawing Sheets

AUTOMATIC BOW RETENTION DEVICE

FIELD OF INVENTION

The invention relates to a device for archery, specifically to a bow retention device for use in releasing tension on the bowstring and for making adjustments or repairs to the apparatus of a compound archery bow.

PRIOR ART BACKGROUND

The modern compound archery bow is a machine that must be maintained in proper adjustment to function effectively and accurately. To perform most tune-up adjustments, tension must first be relieved from the bowstring and the bow pulley cables. A typical compound bow exerts a tension of several hundred pounds on the bowstring even while the bow is not drawn. A defective bowstring cannot be relied on to withstand this tension and must be replaced when it shows damage or wear. This very high force of tension requires a mechanical means for tensioning and retaining the bow to allow repairs or adjustments to the bowstring apparatus or replacement of the bowstring A device for this purpose is commonly referred to as a bow press. The type of bow press typical in commercial use for servicing the archery bow consists of a rigid framework to which the bow is attached and machinery for compressing and retaining the bow under tension. Such a bow press is described in U.S. Pat. No. 5,370,103 by John G. Wagner. It comprises a jack and a pair of horizontal beams, one of which connects to the handle section of the bow while the other bears on the flexible limbs of the bow with a pair of rollers. The jack draws the two bars toward each other to tension the bow and relax the bowstring and associated bow pulley cables. Another bow press of this type, disclosed in U.S. Pat. No. 5,222,473 to Gary T. Lint, uses a pair of struts, each of which attaches to a jack and to one limb at either end of the bow. The jack is mounted on a block which bears on the limbs of the bow at the points where they are connected to the handle section of the bow. The struts pull back the limbs of the bow with an action similar to that of the bowstring, under pressure applied by the jack at the central point joining the two struts to the jack. Both of the approaches described above employ some type of jack to apply tensioning force to the bow. While this type of bow press can be used to easily and quickly disassemble a compound bow, it is physically large and must be solidly mounted to be used effectively.

A small, portable bow press would offer the obvious advantage of being usable by the archer at home or in the field to re-string the bow or to make other repairs. One such portable bow press is described in U.S. Pat. No. 5,425,350 to Ralph R Egusquiza. It is comprised of a turnbuckle between two lengths of cable to apply tensioning force to the limbs of the bow. A similar approach, disclosed in U.S. Pat. No. 5,125,389 to Nicely and Nicely, uses a continuous length of cable connected to the ends of the bow limbs. A screw apparatus pushes open a loop in the cable to shorten the cable and tension the bow. While this approach is simple and reliable, it takes time and requires considerable manipulation of a screw to obtain sufficient tensioning of the bow to relax the bowstring. This is a serious disadvantage because adjustment of the bow usually requires a repetitive process of testing it with the string under tension, refining the adjustment, then re-testing.

If a bowstring is in place, using it to tension the bow naturally eliminates the need for any sort of jack or screw in a bow press or bow retention device. A bow locking device is described in U.S. Pat. No. 4,886,039 to John G. Wagner comprising a pawl and ratchet mechanism which engages to lock the drawn bow when tension on the bowstring is released. A subsequent pull on the bowstring disengages the mechanism allowing the bow to fire. This invention is for the purpose of holding the bow in a firing position without the full tension of the bow being held by the archer. It incorporates the bowstring pulleys and pulley cables as part of the locking mechanism and therefore does not allow removal of the pulleys or pulley cables. The invention is not suited nor is it intended to serve as a bow press or bow retention device for servicing the bow.

SUMMARY

The present invention is an automatic bow retention device for the purpose of holding a compound archery bow under tension while removing tension from the bowstring, bowstring pulleys and pulley cables. The device is comprised of a tensioning cord which connects to the ends of the limbs of the bow, a spring-loaded spool on which the cord is wound, and a ratchet mechanism to retain the tensioning cord. Attachment of the automatic bow retention device to the bow is performed quickly by dropping an anchor at each end of the tensioning cord through the inner end of each channel where the bow pulleys are situated on the bow. Once the device is attached, the bow is tensioned and made ready for repair or adjustment by manually drawing the bowstring to desired flexure of the bow. When the bowstring is drawn, the cord is automatically wound on the spring-loaded spool to constrain the bow limbs. The ratchet mechanism allows the spring-loaded spool to wind the cord against the flexed limbs of the bow but prevents the spool from unwinding when manual tension on the bowstring is relieved, thus holding the limbs of the bow under tension and relieving tension on the bowstring, bowstring pulleys, and pulley cables. This allows removal or replacement of a bowstring as well as repairs or adjustments to the mechanism of the bow. Once repairs have been made, a switch is turned on the ratchet mechanism setting the ratchet mechanism to release when the bowstring is again drawn tight. Once the tension is being held manually by the drawn bowstring, it can then be released from the bow by relieving tension on the bowstring.

While in most cases a bow to be serviced already has a bowstring in place, in those instances when a string must be installed on an unstrung bow, the device could be used to manually tension the bow by the use of accessory handles, one of which attaches to the device housing and the other to the spool, providing the leverage necessary to wind the tensioning cord onto the spool to tension the bow.

OBJECTS AND ADVANTAGES

Several objects and advantages of the invention are:

(a) to provide a bow retention device for use by an archer at home or in the field to repair, adjust, or otherwise service a compound archery bow.

(b) to provide a compact and portable bow retention device for repairing, adjusting, or otherwise servicing a compound archery bow.

(c) to provide a means for quickly tensioning and relaxing the bow to facilitate rapid repairs and adjustments.

(d) to provide a bow retention device which does not require a jack, screw or any means for applying force to tension a bow other than the bowstring apparatus.

Further objects and advantages of the automatic bow retention device will become apparent from a consideration of the drawings and ensuing description.

DRAWING FIGURES

FIG. 1 depicts a compound archery bow with a bowstring and with the automatic bow retention device attached to the bow in position for use.

FIG. 2 is a detail drawing of one end of one limb of the bow showing how the automatic bow retention device is attached to the bow.

FIG. 3A is an exploded view of the automatic bow retention device showing its component parts.

FIG. 3B shows a different configuration of the component parts shown in FIG. 3A.

FIG. 4 is a detail drawing of several component parts of the automatic bow retention device.

FIG. 5 shows the automatic bow retention device with accessory handles to be used with the device for tensioning an unstrung bow.

REFERENCE NUMERALS IN DRAWINGS

10 automatic bow retention device
12 tensioning cord
14 tensioning cord anchor
16 bow limb
18 bow handle section
20 bowstring
21 pulley cable
22 bowstring pulley
24 housing
26 ratchet teeth
28 cord spool
30 return spring
32 spring/spool pin
34 spring/housing pin
36 spool retention screw
38 spool retention washer
40 pawl
42 pawl pin
44 ratchet switch
46 ratchet switch plunger
48 fixed accessory handle
50 movable accessory handle
51 handle stay
52 handle attachment pin
54 handle stay

DESCRIPTION OF DRAWINGS

A view of a preferred embodiment of automatic bow retention device 10 of the present invention is shown in FIG. 1, as installed for use on a compound archery bow. Tensioning cord 12 is made of a flexible fiber material of high tensile strength. A tensioning cord anchor 14 is fixed to each end of tensioning cord 12 for attachment to each bow limb 16. To attach the invention to the bow, each tensioning cord anchor 14 is inserted through the channel at the end of each bow limb 16 in which bow string pulley 22 is mounted. A detail view of the attachment of tensioning cord 12 to bow limb 16 is presented in FIG. 2.

Figure 1:
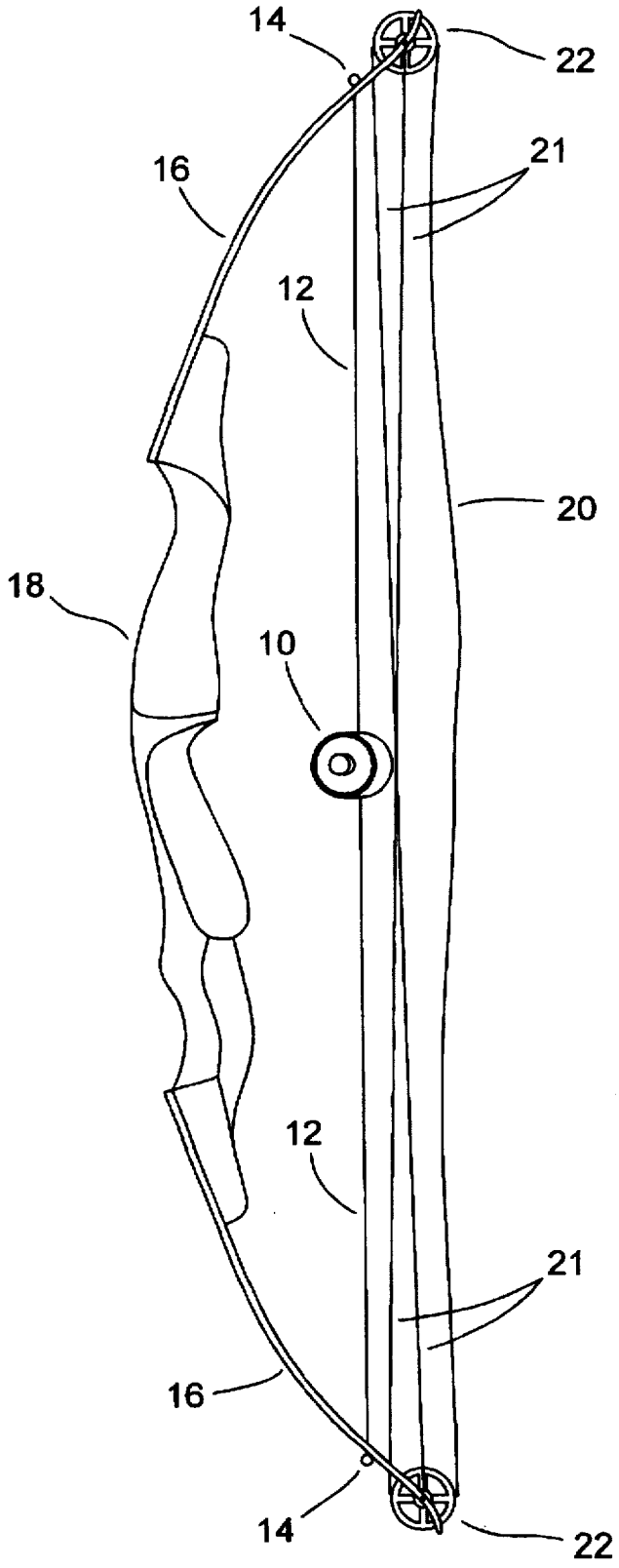
Figure 2:
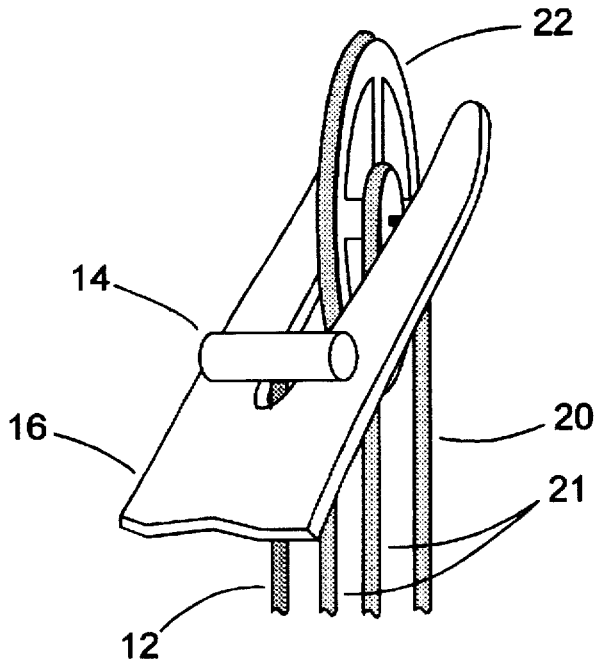

Again referring to FIG. 3A, tensioning cord 12 is automatically wound onto cord spool 28 under the action of return spring 30 as the bow is drawn. Tensioning cord anchor 14 is thereby held against bow limb 16 as the bow limb is flexed under tension applied by bowstring 20. While the bow is being drawn, the bow is held under manual tension by the person drawing the bowstring. As the manual tension is released, a ratchet mechanism engages cord spool 28 against housing 24 to hold the tension of each bow limb 16 on tensioning cord 12 thus removing tension from bowstring 20 and pulley cable 21.

Figure 3A:
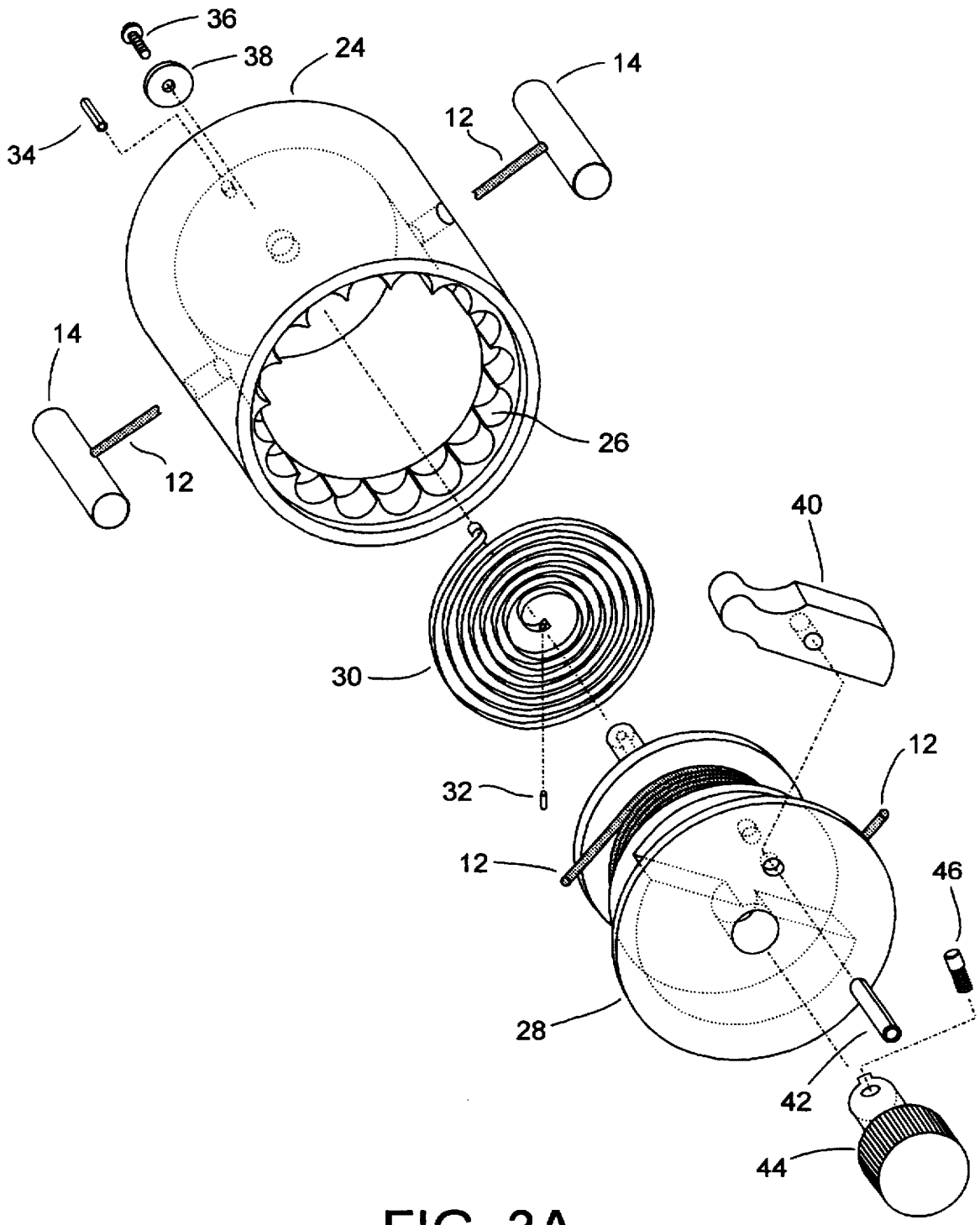
FIG. 3A shows the essential component parts of a preferred embodiment of the invention in exploded view. Tensioning cord 12 passes through holes on opposite sides of housing 24 and through a hole in cord spool 28 which is shown in the detail drawing of FIG. 4. Housing 24 functions as a fixed bail to wind tensioning cord 12 onto cord spool 28. It can fully enclose the spool, as shown in the figure, or can be an open framework, borne by the spool, with guides for the cord. Cord spool 28 fits into housing 24 with sufficient clearance to allow the spool to rotate freely in the housing. Cord spool 28 is held in place in housing 24 by a spool retention screw 36 and a screw retention washer 38 which stands off of the surface of housing 24 with sufficient clearance to allow the cord spool to rotate freely. Return spring 30 is attached to cord spool 28 by a spring/spool pin 32 and to housing 24 by a spring/housing pin 34.
Figure 3B:
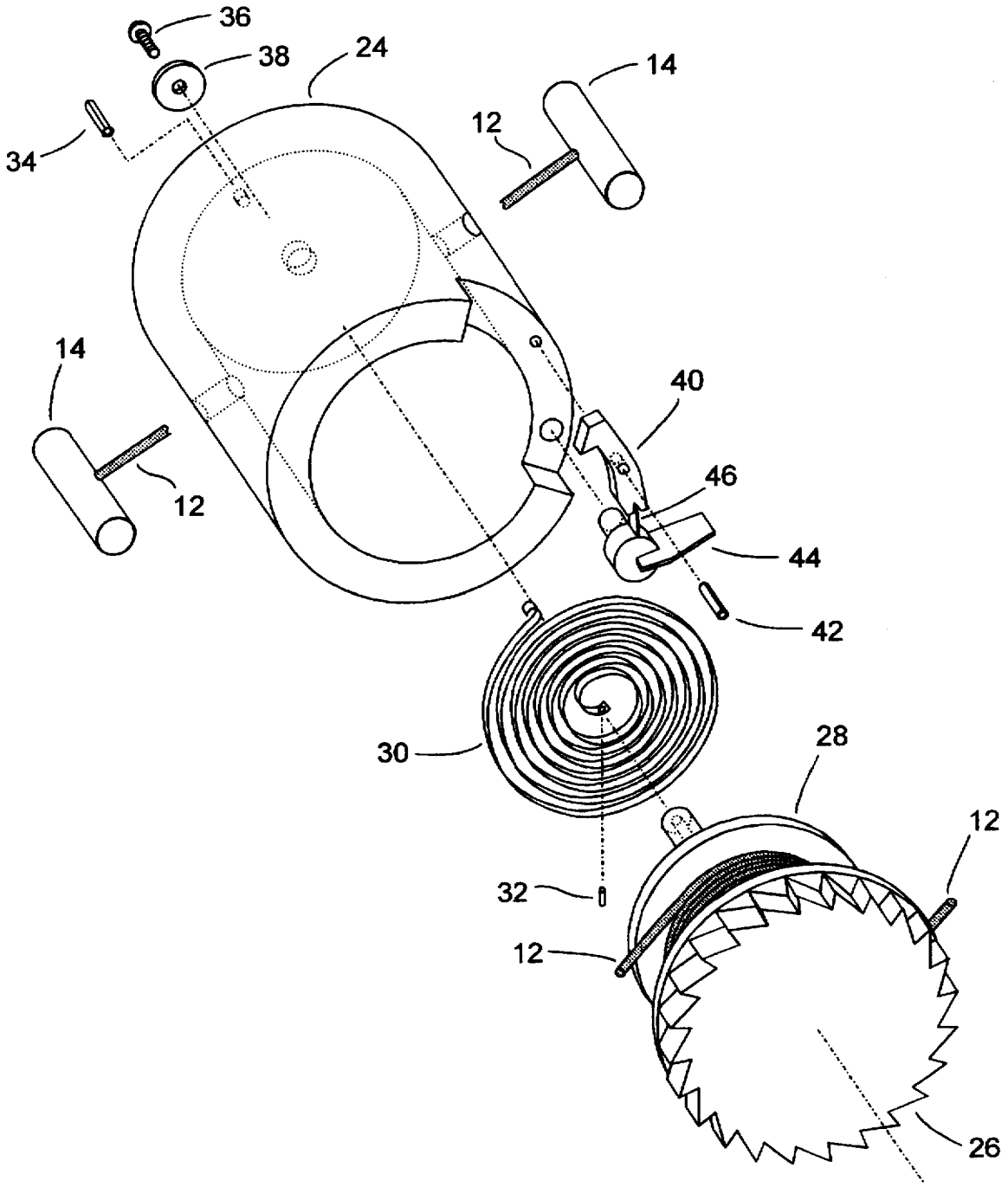
Figure 4:
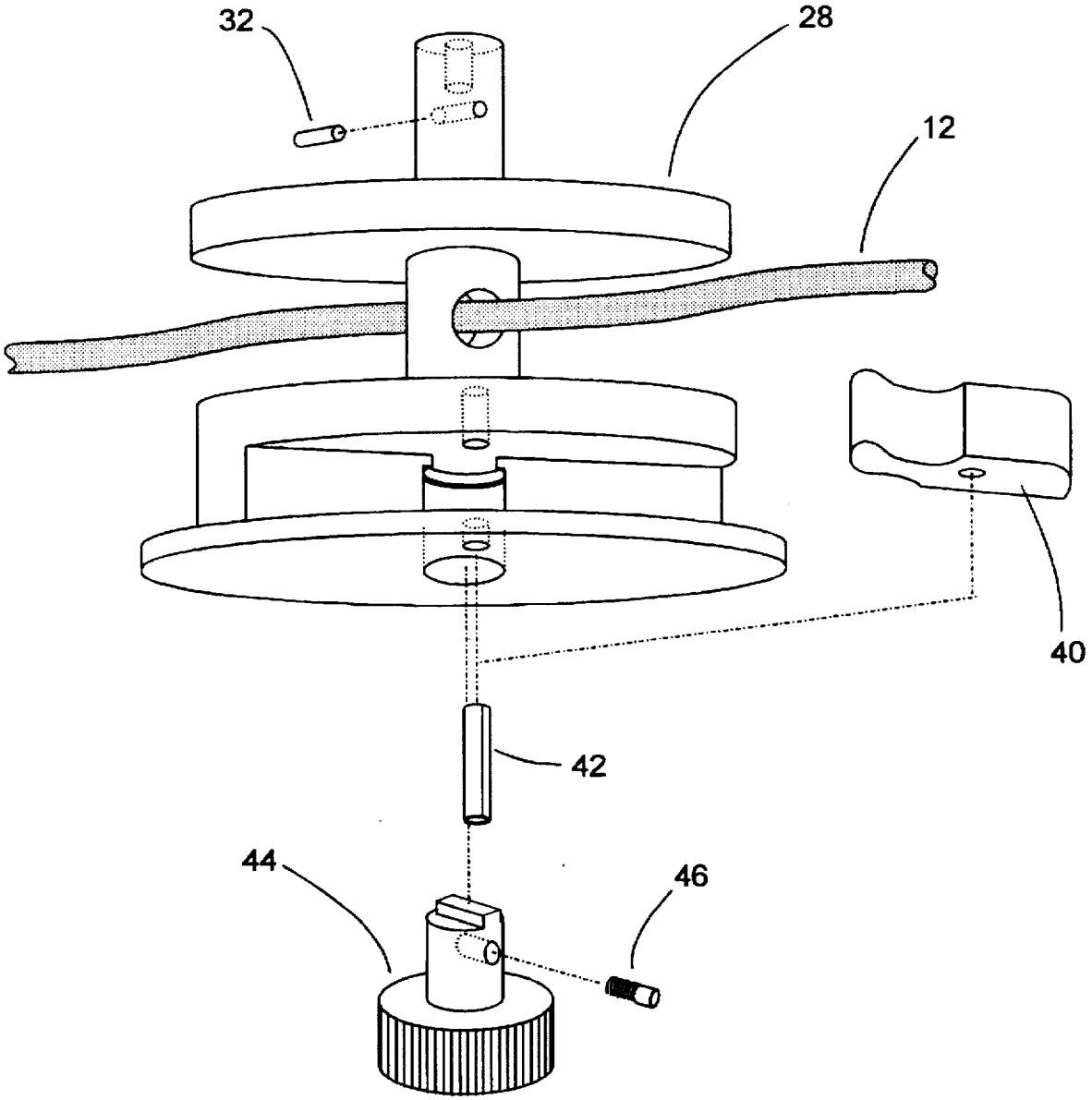

The aforementioned ratchet mechanism is comprised of pawl 40, ratchet teeth 26, ratchet switch 44, and ratchet switch plunger 46 which are depicted in FIG. 3A. Pawl 40 is held in place on cord spool 28 by pawl pin 42 which is press fit into holes in cord spool 28. A clearance hole in pawl 40 which receives pawl pin 42 allows the pawl to rotate through a range of motion sufficient to engage and disengage the pawl from ratchet teeth 26 which form a part of housing 24. Ratchet switch 44 fits into cord spool 28 with sufficient clearance to allow the switch to be turned easily by hand. A ratchet switch plunger 46 fits loosely into a hole in the ratchet switch and bears against pawl 40 under spring tension. Ratchet switch 44 is constrained to turn in cord spool 28 between two positions. At one position of ratchet switch 44, ratchet switch plunger 46 presses against one end of pawl 40 to engage the pawl with ratchet teeth 26. At the other position of the ratchet switch, the plunger presses against the opposite end of the pawl to disengage the pawl from the ratchet teeth when torque applied to cord spool 28 by tension in tensioning cord 12 is relieved. FIG. 3B shows all of the same component parts as in FIG. 3A with pawl 40 shown as it engages with ratchet teeth 26 and showing ratchet switch 44 and ratchet switch plunger 46 as they bear on pawl 40. Detail views of cord spool 28 with pawl 40, with ratchet switch 44 and ratchet switch plunger 46 are presented in FIG. 4.

Figure 5:
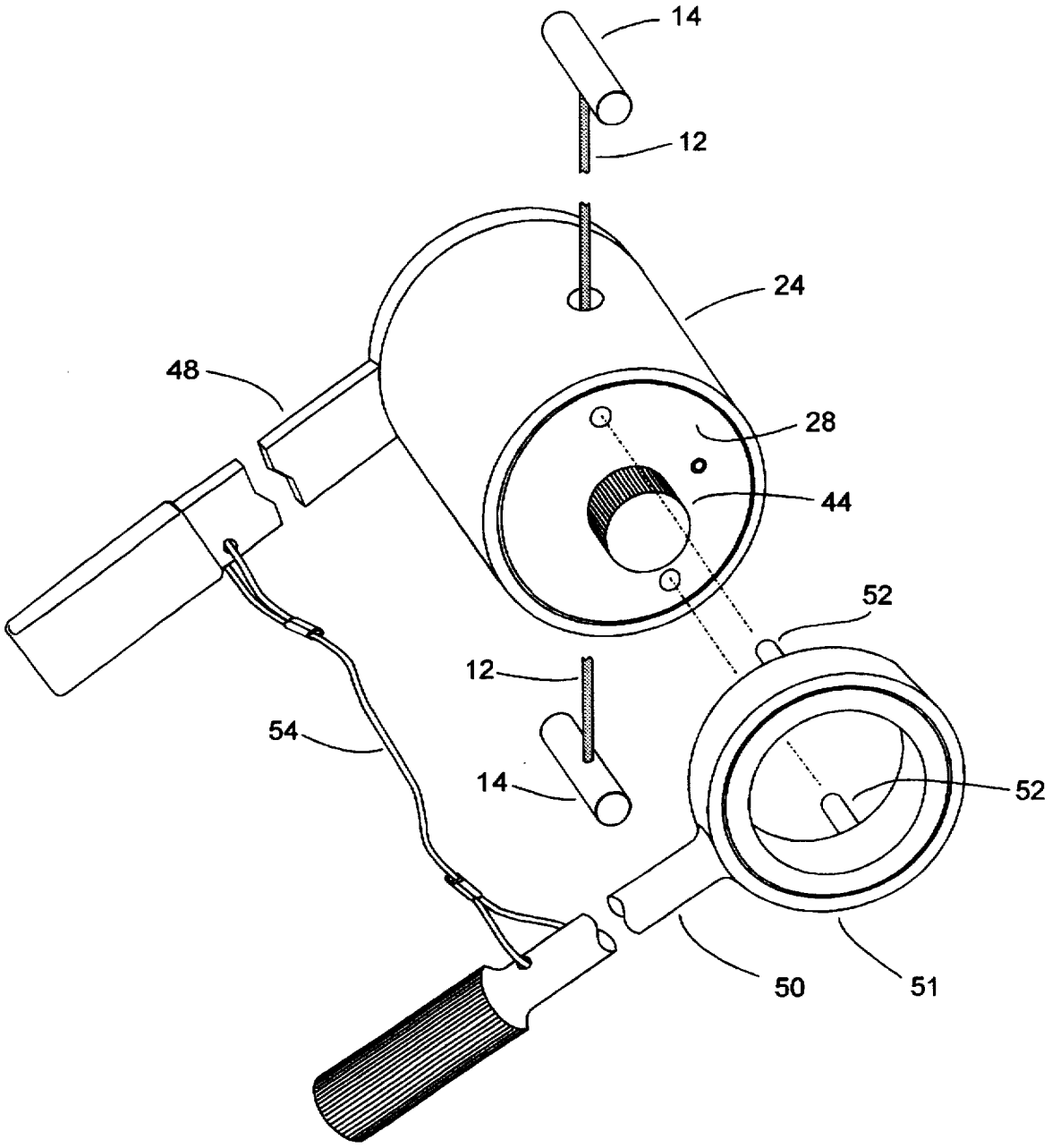

In most instances, a compound archery bow requiring repair or adjustment will already have a bowstring in place providing mechanical means for applying the tension which is held by the automatic bow retention device of the present invention. When a bow string is not in place, the invention can be converted to manual operation by attaching handles to apply the torque required to wind tensioning cord 12 onto cord spool 28, thereby tensioning the bow. One such embodiment of the invention is presented in FIG. 5. In the figure, a fixed accessory handle 48 attaches to housing 24. A movable accessory handle 50 attaches to cord spool 28 by handle attachment pins 52. Movable accessory handle 50 is fitted with a ratchet head 51 to allow the handle to return freely to its starting position while cord spool 28 is held in place by its own ratchet mechanism. The movable handle is thereby operated in the manner of a common ratchet wrench to turn the cord spool in one direction only. The figure shows holes in the cord spool to receive each handle attachment pin. A handle stay 54 connects movable accessory handle 50 to fixed accessory handle 48. Handle stay 54 allows a sufficient range of motion of the movable handle to tension the bow while preventing the handle from turning out of control in case of accidental release of the previously described ratchet mechanism.

Although the description above contains many specificities, these should not be construed as limiting the scope of the invention but as merely providing illustrations of some of the presently preferred embodiments of the invention. For example, cord spool 28 could be fitted with ratchet teeth 26 while pawl 40 is attached to housing 24, as shown in FIG. 3B;; tensioning cord 12 could attach to each bow limb 16 by other means than tensioning cord anchor 14, etc.

I claim:

1. For use with an archery bow including first and second flexible limbs with respective first and second limb tips, a bowstring extending between the limb tips such that as the bowstring is drawn the limbs will flex under tension, drawing the limb tips closer to each other, a bow retention device for maintaining the bow limbs in the drawn and tensioned condition even after the bowstring is relaxed, said device comprising:

a housing;

a spool rotatable within the housing;

first and second cord segments received and windable onto said spool, said first cord segment passing through said housing and including means to attach said first cord segment to said first bow limb tip; said second cord segment passing through said housing and including means to attach said second cord segment to said second limb tip;

a spring means attached between said housing and said spool for rotatably biasing the spool in a first direction to wind said cord segments onto said spool;

a ratchet means attached between said housing and said spool, said ratchet means movable between: (1) a first position in which said ratchet means permits rotation of said spool in said first direction but prevents rotation of said spool in a second direction in which said cord segments are unwound from said spool, and (2) a second position in which rotation of said spool in said first and said second directions is permitted;

whereby, when said device is installed on a bow with said first cord segment attached to said first limb tip, and said second cord segment attached to said second limb tip, and said ratchet is in said first position, as the bowstring is drawn and the limb tips move closer to each other, the cord segments will be wound onto the spool and when the bowstring is released, the cord segments will be prevented from unwinding from the spool, thus maintaining bow tension, and whereby bow tension may be again relaxed by moving the ratchet to said second position and drawing the bow slightly to release said ratchet means, thus allowing the cord segments to unwind from the spool as the bowstring is relaxed.

2. The bow retention device of claim 1 wherein said first and second cord segments are part of a continuous cord which passes through a hole in said spool.

3. The bow retention device of claim 1 wherein said ratchet means comprises a pawl carried on said spool selectively engageable with ratchet teeth carried on said housing, whereby when said pawl is engaged with said ratchet teeth, rotation of said spool in said first direction is permitted and rotation of said spool in said second direction is prevented and when said pawl is disengaged from said ratchet teeth, rotation of said spool in said first direction and said second direction is permitted.

4. The device of claim 3, in which said pawl is hinged on a pawl pin, and a ratchet switch with spring biased ratchet switch plunger is provided, and said ratchet switch is manually movable to a first position in which said pawl is biased by said plunger into engagement with said ratchet teeth, and a second position in which said pawl is biased by said plunger away from said teeth.

5. The device of claim 4, in which, when the device is installed on a tensioned bow, the pawl is held in engagement with one of said teeth, so that, if the ratchet switch is moved to said second position, the pawl will not immediately disengage from said teeth, but if the bowstring is pulled a slight additional distance, said friction will be relaxed, allowing the pawl to disengage from said teeth.

6. The bow retention device of claim 1 wherein said ratchet means comprises a pawl carried on said housing selectively engageable with ratchet teeth carried on said spool, whereby when said pawl is engaged with said ratchet teeth, rotation of said spool in said first direction is permitted and rotation of said spool in said second direction is prevented and when said pawl is disengaged from said ratchet teeth, rotation of said spool in said first direction and said second direction is permitted.

7. The bow retention device of claim 1, including a handle attachable to said housing and a handle attachable to said spool, said handles for manually winding said cord segments onto said spool to tension the bow, instead of pulling a bowstring.

* * * * *